US008718295B2

(12) United States Patent
Sung et al.

(10) Patent No.: US 8,718,295 B2
(45) Date of Patent: May 6, 2014

(54) HEADSET ASSEMBLY WITH RECORDING FUNCTION FOR COMMUNICATION

(75) Inventors: Po-Hsun Sung, Taichung (TW); Chia-Chung Lin, Taichung (TW)

(73) Assignee: Merry Electronics Co., Ltd., Taichung (TW)

( * ) Notice: Subject to any disclaimer, the term of this patent is extended or adjusted under 35 U.S.C. 154(b) by 439 days.

(21) Appl. No.: 13/084,323

(22) Filed: Apr. 11, 2011

(65) Prior Publication Data

US 2012/0257764 A1 Oct. 11, 2012

(51) Int. Cl.
*H04R 1/10* (2006.01)

(52) U.S. Cl.
USPC ..... 381/74; 381/94.1

(58) Field of Classification Search
CPC ... H04R 5/033; H04R 1/1041; H04R 2420/07
USPC ..... 381/74, 94.1–94.4, 309, 123, 320; 379/430, 419, 428.01, 207.02; 455/41.2, 41.3, 39, 550.1, 569.1
See application file for complete search history.

(56) References Cited

U.S. PATENT DOCUMENTS

| | | | | |
|---|---|---|---|---|
| 7,065,219 | B1 * | 6/2006 | Abe et al. | 381/74 |
| 7,623,667 | B2 * | 11/2009 | Sander et al. | 381/74 |
| 8,254,591 | B2 * | 8/2012 | Goldstein et al. | 381/74 |
| 8,401,178 | B2 * | 3/2013 | Chen et al. | 379/406.03 |
| 2009/0022294 | A1 * | 1/2009 | Goldstein et al. | 379/207.02 |

* cited by examiner

*Primary Examiner* — Lun-See Lao
(74) *Attorney, Agent, or Firm* — Muncy, Geissler, Olds & Lowe, P.C.

(57) ABSTRACT

A headset assembly with a recording function for communication includes a left earphone, a right earphone, a call module, and a recording module. The left and the right earphones respectively have a speaker and a microphone. The call module is electrically connected to the left or the right earphone. The recording module is electrically connected to the left and the right earphones. In a first operation mode, the call module communicates with an external communication device through the microphone and the speaker of the left or the right earphone. In a second operation mode, the recording module receives an ambient sound signal through the microphones simultaneously, and records and stores the ambient sound signal. As the microphones are placed in a left auricle and a right auricle, recorded sound may have an effect of a head-related transfer function (HRTF), thus achieving an effect of a stereo sound field during playback.

6 Claims, 5 Drawing Sheets

HEADSET ASSEMBLY WITH RECORDING FUNCTION FOR COMMUNICATION

BACKGROUND OF THE INVENTION

1. Field of Invention

The present disclosure relates to a headset assembly, and more particularly to a headset assembly with a recording function for communication, which has speakers and microphones and is capable of integrating a recording function and a noise reduction function.

2. Related Art

Earphone is an indispensable accessory in current portable electronic products (such as mobile phones, MP3 players, and personal digital assistants (PDAs)). In recent years, with the rapid popularization of mobile phones, a headset assembly formed by an earphone and a microphone in combination provides a hand-free receiver function of mobile phones for users, thus achieving security and convenience in call.

FIG. 1 is a schematic structural view of a conventional headset assembly. As shown in FIG. 1, a conventional headset assembly 10 is electrically connected to a mobile phone 20, and includes a left earphone 11, a right earphone 12, and a microphone 13. The left earphone 11 and the right earphone 12 are connected to the microphone 13, and then connected to the mobile phone 20. A left speaker 111 is disposed in the left earphone 11, and a right speaker 121 is disposed in the right earphone 12, such that a user may use the headset assembly 10 in combination with the mobile phone 20 for communication, that is, use the left speaker 111 and the right speaker 121 for receiving an audio signal, and use the microphone 13 for transmitting an audio signal. If a music playing module is disposed in the mobile phone 20, a music signal may also be transmitted through the left speaker 111 and the right speaker 121.

The conventional headset assembly 10 has been already provided the most basic functions of communication and music listening required for users. However, if a single accessory can perform more functions, the users can pay more attention to immerse various multimedia, and the trouble of carrying different accessories for achieving different functions can be eliminated.

SUMMARY OF THE INVENTION

Accordingly, embodiments are directed to a headset assembly with a recording function for communication, which is capable of performing a noise reduction function or a recording function in combination with a circuit module in different operation modes through microphones disposed on a left earphone and a right earphone. In a noise reduction function mode, the left microphone and the right microphone receive ambient noise, generate an inverted acoustic wave through a circuit, and output the inverted acoustic wave through speakers disposed on the left and right earphones, such that the user can listen to a clear sound signal. On the other hand, in a recording function mode, the left and right microphones receive ambient sound, and reproduce a stereo sound signal in the recording mode.

In order to achieve the above objectives, the headset assembly with a recording function for communication of the embodiment comprises a left earphone, a right earphone, a call module, and a recording module. The left earphone comprises a left speaker and a left microphone. The right earphone comprises a right speaker and a right microphone. The call module is electrically connected to one of the left earphone or the right earphone. The recording module is electrically connected to the left earphone and the right earphone. In a first operation mode, the call module communicates with an external communication device through the microphone and the speaker of the left earphone or the right earphone. In a second operation mode, the recording module receives an ambient sound signal through the left microphone and the right microphone, and records and stores the ambient sound signal.

In order to achieve the above objectives, the headset assembly with a recording function for communication of the embodiment further comprises a noise reduction module electrically connected to the two earphones. In a third operation mode, the noise reduction module receives the ambient sound signal through the microphones, and generates a noise reduction signal and transmits the noise reduction signal to the speakers.

In view of the above, compared with the prior art, the headset assembly with a recording function for communication of the embodiment integrates multiple functions of calling, recording, and noise reduction. Therefore, when one listening to music, not only the general communication can be performed, but also a sound signal containing a head-related transfer function (HRTF) of the ambient environment can be recorded in time through the recording function, and a stereo sound field effect is achieved during playback. Furthermore, the ambient noise signal may be reduced or eliminated through the noise reduction function, such that a better listening experience can be achieved when listening to music. Thus, the user may only need to carry one headset assembly to achieve multiple functions, and the trouble of carrying many accessories is eliminated.

BRIEF DESCRIPTION OF THE DRAWINGS

The embodiments will become more fully understood from the detailed description given herein below for illustration only, and thus are not limitative of the embodiment, and wherein.

DETAILED DESCRIPTION OF THE INVENTION

A headset assembly with a recording function for communication according to embodiments of the disclosure is illustrated with reference to accompanying drawings.

Figure 1:
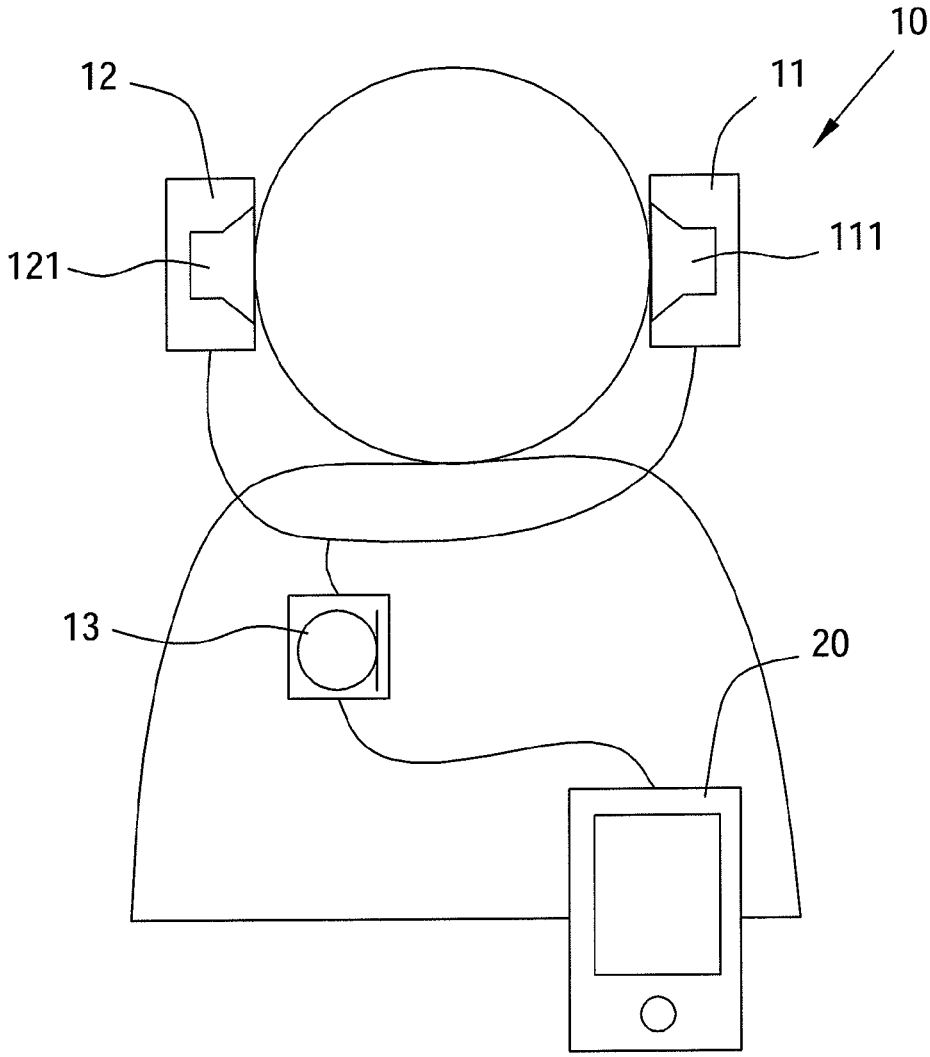
Fig. 1 (prior art)
FIG. 1 is a structural view of a conventional headset assembly.
Figure 2:
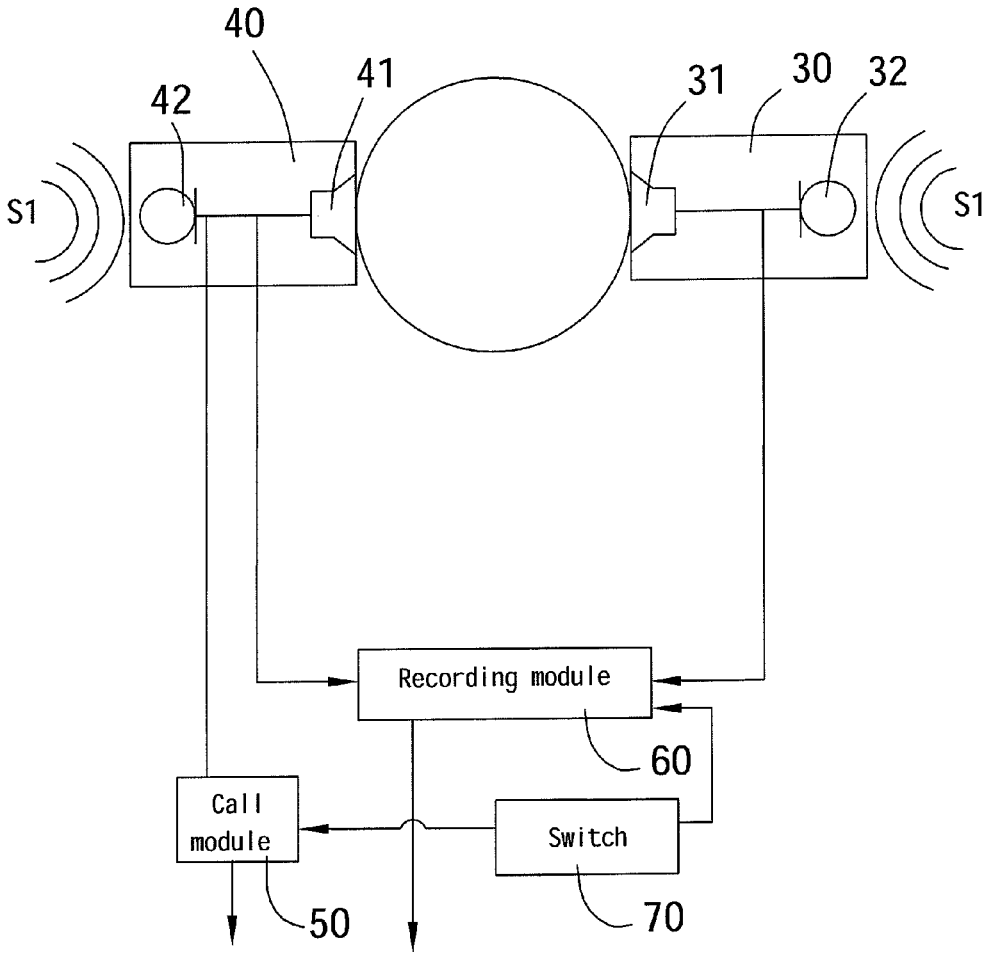
FIG. 2 is a view illustrating connection relations between modules of a headset assembly with a recording function for communication according to an embodiment.

FIG. 2 is a view illustrating connection relations between modules of a headset assembly with a recording function for communication according to an embodiment. As shown in FIG. 2, the headset assembly with a recording function for communication includes a left earphone 30, a right earphone 40, a call module 50, and a recording module 60. The left earphone 30 includes a left speaker 31 and a left microphone 32. The right earphone 40 includes a right speaker 41 and a right microphone 42. The call module 50 is electrically connected to one of the left earphone 30 or the right earphone 40. The recording module 60 is electrically connected to the left earphone 30 and the right earphone 40. In a first operation mode, the call module 50 communicates with an external communication device through the microphone 32 (42) and the speaker 31 (41) of the left earphone 30 or the right earphone 40. In a second operation mode, the recording module 60 receives an ambient sound signal S1 through the left microphone 32 and the right microphone 42, and records and stores the ambient sound signal S1.

In the first operation mode, the left microphone 32 or the right microphone 42 receives a voice signal transmitted to the microphone 32 or 42 through the ear canal from the Eustachian tube, through the vibration of the skull, and through outside air from the mouth, and transmits the voice signal to the other party through the communication device, and receive the voice signal from the other party, and then the communication device transmits the voice signal to the left speaker 31 or the right speaker 41, so as to transmit the voice signal of the other party to a user. As for the technology for receiving the voice signal from the ear canal, reference is made to the structural arrangement in FIG. 4, and such a technology is realized through sound propagation principles of skull conduction and air conduction.

In this embodiment, the headset assembly may further include a switch 70, which is electrically connected to the call module 50 and the recording module 60, for being operated to switch to the first operation mode or the second operation mode.

The recording module 60 cooperates with the left microphone 32 and the right microphone 42 disposed in the left ear and the right ear of the user respectively. As the microphones are placed next to the auricle, the recorded ambient sound signal S1 is very similar to the sound field felt by the ear-drum of the user, in which the difference lies in a transfer function of an ear reference point and an ear-drum reference point. However, as the received signal contains the personalized HRTF effect of the user, and through the adjustment of combining the circuit with an equalizer, when the wearer hears the recorded and stored sound through the left speaker 31 and the right speaker 41, the three-dimensional space feeling of the sound field where the recorder is originally located may be reproduced during replay.

Herein, it should be noted that, the refraction and diffraction of sound waves by human auricle, ear canal, skull, and shoulder has a certain influence on the sound when the human ear hears the sound. Acoustically, the influence is generally described with the HRTF. Due to the influence of the HRTF, the human brain can determine the direction and distance of the sound based on experience. Conventionally, when one listening to music through earphones, the sound is directly "filled" into the ears through speakers of the earphones, that is, the influence on the sound caused by the human auricle, skull, and shoulder does not exist, such that in this case, the human brain cannot accurately determine the direction and distance of the sound. Furthermore, in conventional stereo sound recording, the microphones of left and right channels are several meters or more than ten meters away from each other, but the stereo sound signal obtained with such a distance is filled into two ears by two earphone speakers which are only 30 cm away from each other, with the result that most of the sound field is squeezed between the left and right ears. Therefore, if the two microphones 32 and 42 are disposed at the left and right ears of the user according to the embodiment, when the originally recorded sound is reproduced, the HRTF effect can be added, such that the user may have stereo feeling and determine the direction and distance.

It should be further noted that, the call module 50 is electrically connected to only the right earphone 40 herein, but it may also be electrically connected to the left earphone 30 and the right earphone 40 simultaneously, so as to receive the voice signals transmitted from the ear canals of the two ears simultaneously.

Figure 3:
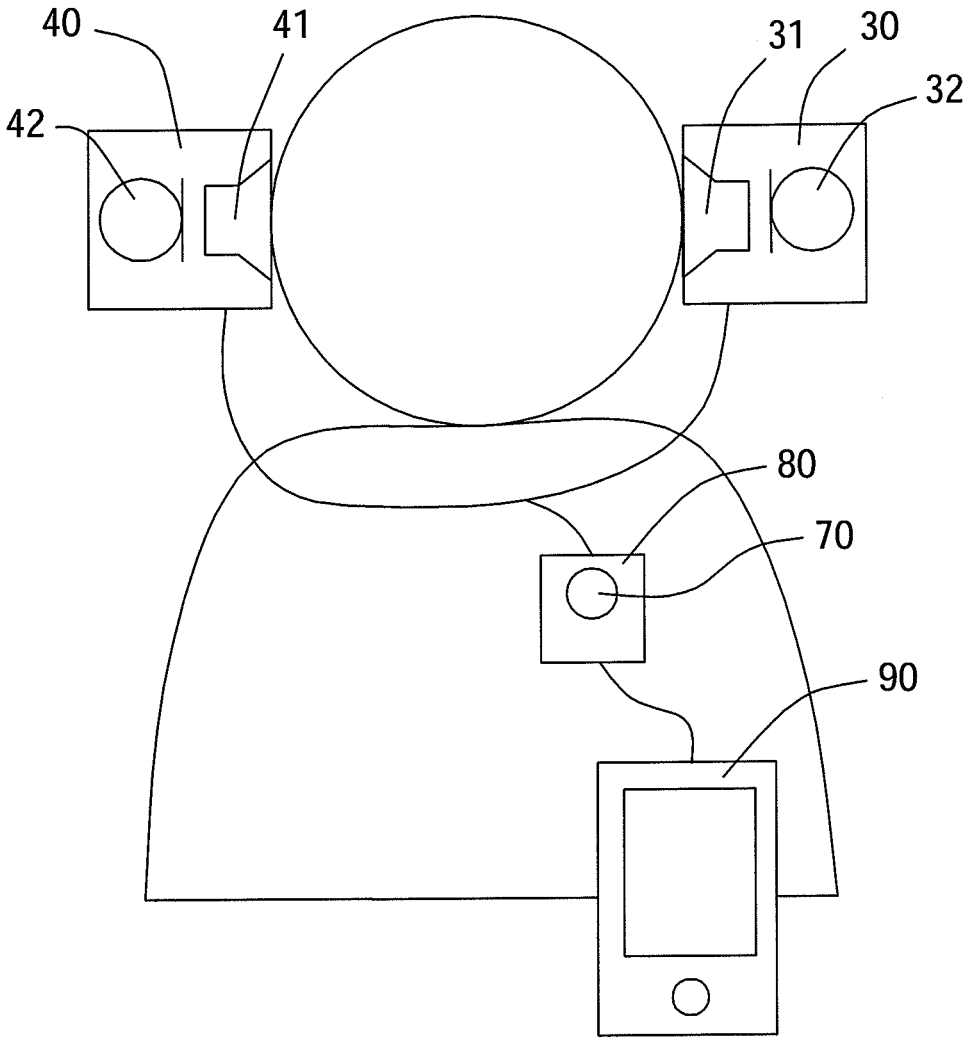
FIG. 3 is a structural view of the headset assembly with a recording function for communication according to the embodiment.

FIG. 3 is a schematic structural view of the headset assembly with a recording function for communication according to the embodiment. As shown in FIG. 3, the call module 50 and the recording module 60 in FIG. 2 may be integrated in a control box 80, and the switch 70 may be disposed outside the control box 80, for being switched by the user of the headset assembly directly from the outside, so as to change the calling or recording mode.

In fact, the switch 70 may also be implemented as an acoustic switch, and may also be disposed in the control box 80, such that the user can directly send a voice command to the control box 80, so as to switch to different operation modes.

Furthermore, in FIG. 3, the communication device 90 is also provided to be connected to the headset assembly, in which the communication device 90 has a music playing module therein for outputting a music signal to the left speaker 31 and the right speaker 41, such that the user can communicate with other persons through the call module 50 and the communication device 90 in combination. Additionally, with the development of the technology of the communication device 90, the call module 50, the recording module 60, and the switch 70 may be directly integrated in the communication device 90, such that the user can directly perform the switching operation on the communication device 90, and thus the arrangement of the control box 80 is omitted, and the sound signal recorded by the recording module 60 may be stored in the communication device 90.

Figure 4:
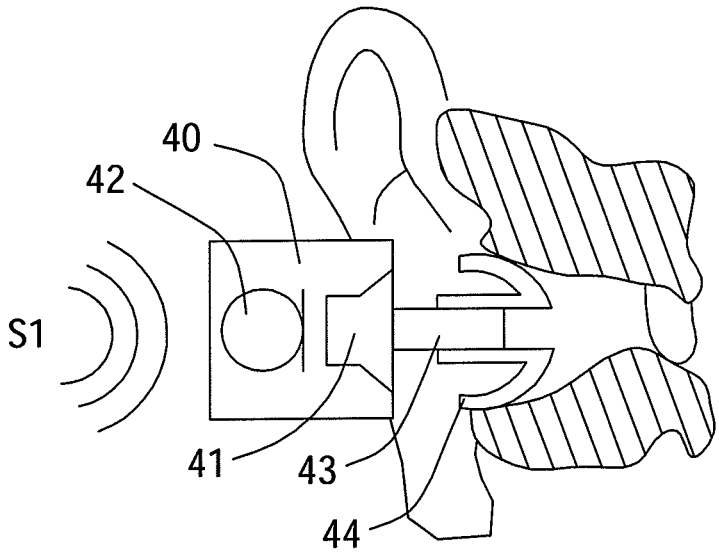
FIG. 4 is a view of the headset assembly with a recording function for communication of the embodiment when being implemented as an in-ear earphone.
Figure 5:
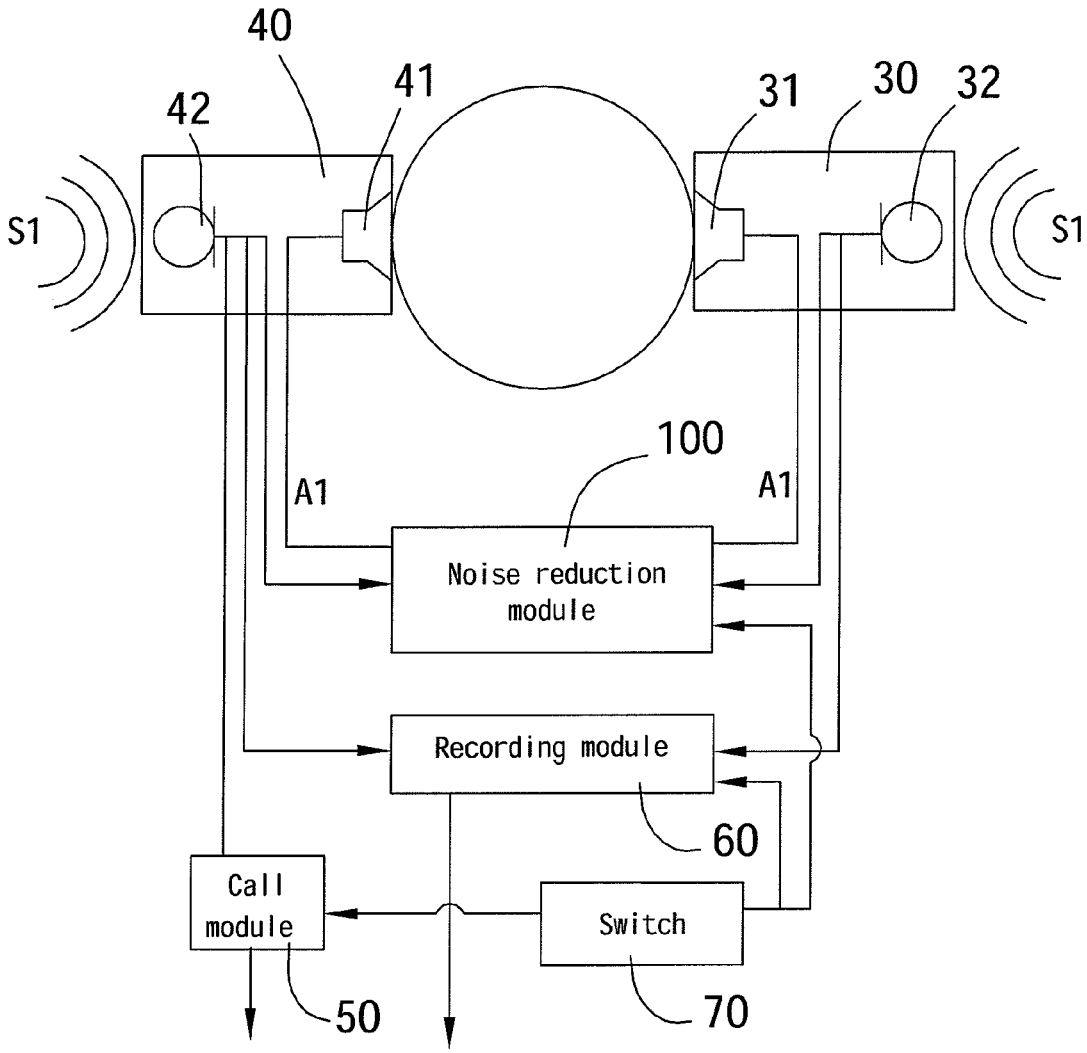
FIG. 5 is a schematic view illustrating connection relations between modules of a headset assembly with a recording function for communication according to another embodiment.

FIG. 4 is a view of the headset assembly with a recording function for communication according to the embodiment when being implemented as an in-ear earphone, and FIG. 5 is a schematic view illustrating connection relations between modules of the headset assembly with a recording function for communication according to the embodiment with a noise reduction module added. Referring to FIG. 4, a view of implementation of the right earphone 40 is shown. Since the left earphone 30 is implemented symmetrically herein, it will not be further illustrated with any drawing. In FIG. 4, a sound induction tube 43 extends from the right earphone 40, and an earplug part 44 is sleeved onto the front edge of the sound induction tube 43, such that when the right earphone 40 is inserted into the ear canal of the user, some noise may be passively isolated by the earplug part 44, and the sound signal may be directly transmitted to the ear canal through the sound induction tube 43 from the speaker 41.

In FIG. 5, a noise reduction module 100 may be added in the headset assembly. The noise reduction module 100 may be electrically connected to the two earphones 30 and 40. In a third operation mode, the noise reduction module 100 may receive the ambient sound signal S1 through the microphones 32 and 42, and generates a noise reduction signal A1 and transmits the noise reduction signal A1 to the speakers 31 and 41.

An active noise reduction circuit or an active noise reduction chip may be disposed in the noise reduction module 100, and the circuit or the chip firstly receives the ambient sound signal S1, generates a noise reduction signal A1 with the same frequency and an inverted phase through internal processing operation, and transmits the noise reduction signal A1 to the left speaker 31 and the right speaker 41. Thus, the left speaker 31 and the right speaker 41 receive the ambient sound signal S1, the noise reduction signal A1, and the music signal simultaneously. By the noise reduction signal A1 with the same frequency and an inverted phase, the noise in the ambient sound signal S1 is significantly reduced or even eliminated. Therefore, in a noise reduction mode, the noise is suppressed or eliminated by the noise reduction module 100, so as to provide a music signal with less or even no noise to the user.

Furthermore, in FIG. 5, the call module 50 may be also electrically connected to the switch 70, so the switch 70 may be operated to switch to the first operation mode, the second operation mode, and the third operation mode herein, that is, switch to the call mode, the recording mode, and the noise reduction mode. Moreover, in this embodiment, the call module 50, the recording module 60, and the noise reduction module 100 may also be integrated in the control box 80 shown in FIG. 3, or integrated in the communication device 90. Definitely, the switch 70 herein may also be integrated in the control box 80 or the communication device 90, and may be designed as a manual switching type or a voice control type.

In view of the above, according to the headset assembly with a recording function for communication according to one embodiments, a call module and a recording module are integrated, such that not only the general communication can be performed, but also a sound signal containing a head-related transfer function (HRTF) of the ambient environment can be recorded in time through the recording function, and a stereo sound field effect is reproduced during playback. Furthermore, according to one embodiment, a noise reduction module may be added, such that the headset assembly may have a noise reduction effect on the ambient sound signal, thereby achieving a good listening experience when one listening to music. Therefore, the headset assembly of the embodiment integrates multiple functions, such that the user can switch and change the functions according to different demands, and only needs to carry a set of headset assembly accessories to process and enjoy more diverse multimedia information.

The invention being thus described, it will be obvious that the same may be varied in many ways. Such variations are not to be regarded as a departure from the spirit and scope of the disclosure, and all such modifications as would be obvious to one skilled in the art are intended to be included within the scope of the following claims.

What is claimed is:

1. A headset assembly with a recording function for communication, comprising:

a left earphone, having a left speaker and a left microphone;

a right earphone, having a right speaker and a right microphone;

a call module, electrically connected to one of the left earphone and the right earphone;

a recording module, electrically connected to the left earphone and the right earphone; and a noise reduction module, electrically connected to the left earphone and the right earphone, for receiving the ambient sound signal through the microphones and generating a noise reduction signal and transmitting the noise reduction signal to the speakers in a third operation mode;

wherein in a first operation mode, the call module communicates with an external communication device through the microphone and the speaker of the left earphone or the right earphone; and in a second operation mode, the recording module receives an ambient sound signal through the left microphone and the right microphone, and records and stores the ambient sound signal;

wherein the call module, the recording module, and the noise reduction module are integrated in a control box, and the control box is disposed between the left and the right earphones and the communication device.

2. The headset assembly with a recording function for communication according to claim 1, further comprising a switch, electrically connected to the recording module and the call module, for being operated to switch to the first operation mode or the second operation mode.

3. The headset assembly with a recording function for communication according to claim 1, wherein the left and the right earphones are in-ear earphones, and one of the microphones of the two earphones receives a voice signal from an ear canal of a user and transmits the voice signal to the communication device.

4. The headset assembly with a recording function for communication according to claim 1, wherein the recording module records and stores the ambient sound signal in the communication device.

5. The headset assembly with a recording function for communication according to claim 1, further comprising a switch, electrically connected to the call module, the recording module, and the noise reduction module, for being operated to switch to the first operation mode, the second operation mode, or the third operation mode.

6. The headset assembly with a recording function for communication according to claim 5, wherein the call module, the recording module, the noise reduction module, and the switch are integrated in the control box, and the control box is disposed between the left and the right earphones and the communication device.

* * * * *